US005946762A

United States Patent [19]

Dionisio

[11] Patent Number: 5,946,762

[45] Date of Patent: Sep. 7, 1999

[54] SQUEEGEE WITH ERGONOMIC HANDLE AND NON-LOOSENING PIVOTABLE BLADE

[76] Inventor: Anthony M. Dionisio, 186 Little E. Neck Rd. S., Babylon, N.Y. 11702

[21] Appl. No.: 09/030,524

[22] Filed: Feb. 24, 1998

[51] Int. Cl.[6] ..... A47L 1/06

[52] U.S. Cl. ..... 15/245; 15/144.1; 15/144.3; 15/235.8

[58] Field of Search ..... 15/144.1, 144.3, 15/235.4, 235.8, 236.01, 245, 245.1

[56] References Cited

U.S. PATENT DOCUMENTS

| | | | |
|---|---|---|---|
| 2,771,623 | 11/1956 | Baril | 15/245 |
| 4,488,460 | 12/1984 | Ballone et al. . | |
| 4,611,363 | 9/1986 | Samuelsson . | |
| 4,847,938 | 7/1989 | Unger | 15/245 |
| 4,993,101 | 2/1991 | Newman et al. | 15/144.1 |
| 5,321,868 | 6/1994 | Coulson et al. . | |
| 5,400,511 | 3/1995 | Decker . | |
| 5,606,772 | 3/1997 | Ilic . | |
| 5,850,663 | 12/1998 | Hardy et al. | 15/245.1 |

*Primary Examiner*—Terrence R. Till
*Attorney, Agent, or Firm*—Richard L. Miller, P.E.

[57] ABSTRACT

A squeegee with ergonomic handle and non-loosening pivotable blade. The squeegee includes a handle for one of attaching to a pole and holding in a hand of a user, a blade portion pivotally mounted to the handle for side to side pivotal movement relative thereto, and pivoting apparatus for pivotally mounting the blade portion to the handle for side to side pivotal movement relative thereto. A flat longitudinal side of a threaded shaft of a specifically configured bolt contacts, and locks against, a flat longitudinal side of a specifically configured throughbore in the handle preventing loosing and rotation of the specifically configured bolt relative to the handle when the blade portion is pivoted relative to the handle, with the tapering of a head of the specifically configured bolt creating a mechanical advantage of increased friction between the head and the flared portion of a specifically configured throughbore in the blade portion, and with the pivoting apparatus being positioned at a slanted edge of the blade portion and the side of the handle and not the center of the blade portion and the center of the handle preventing the blade portion from hitting the hand of the user when it pivots to an extreme.

20 Claims, 2 Drawing Sheets

SQUEEGEE WITH ERGONOMIC HANDLE AND NON-LOOSENING PIVOTABLE BLADE

BACKGROUND OF THE INVENTION

1. Field of the Invention:

The present invention relates to a squeegee. More particularly, the present invention relates to a squeegee with ergonomic handle and non-loosening pivotable blade.

2. Description of the Prior Art:

Numerous innovations for ergonomic devices have been provided in the prior art that will be described. Even though these innovations may be suitable for the specific individual purposes to which they address, however, they differ from the present invention.

FOR EXAMPLE, U.S. Pat. No. 4,488,460 to Ballone et at. teaches an ergonomic handle for a hand tool or other implement that has a substantially elliptical cross-section taken in a first plane which forms a dihedral angle of approximately thirty (30) degrees with respect to a second plane which is normal to the longitudinal axis of the shank of the tool. The length of the minor axis of the elliptical cross-section is approximately sixty percent (60%) of the length of the major axis. The longitudinal axis of the shank passes through the elliptical cross-section and through the line formed by the intersection of the first and second planes. The handle is formed substantially as a revolution of the elliptical cross-section about its major axis. As a result, the handle is well balanced and accommodates a variety of hand grips for various uses or orientations of the tool, and the handle is convenient and comfortable for substantially reducing operator fatigue over extended use of the tool. This is especially advantageous in connection with a hand ratchet tool.

ANOTHER EXAMPLE, U.S. Pat. No. 4,611,363 to Samuelsson teaches a channel-shaped holder having parallel side walls which cooperate to form a cavity therebetween for receiving a cleaning blade. One edge of the cleaning blade is mounted in an elongated channel-shaped cap which includes an elongated slider protruding from one side thereof. The slider is inserted into a selected one of a number of longitudinally-elongated, parallel, laterally spaced apart grooves formed on the interior of the holder to selectively adjust the distance the free edge of such blade projects from the holder.

STILL ANOTHER EXAMPLE, U.S. Pat. No. 5,321,868 to Coulson et al. teaches a squeegee and method of ergonomically modifying a conventional squeegee. A squeegee includes a rigid handle having a convex top side, opposite from a bottom side, and opposing cancave faces longitudinally disposed between the top and bottom sides of the handle. A blade is attached to the bottom side of the handle. A compressible pad is removably secured to the convex topside of the handle providing maximum padding to the palmer regions of the printer's hands. The pad tapers to a minimum thickness at distal edges which are located on or near the concave faces of the handle.

YET ANOTHER EXAMPLE, U.S. Pat. No. 5,400,511 to Decker teaches a thumb piece for a power-driven knife disclosed. The one piece thumb piece includes an annular base portion and a thumb support portion disposed vertically above the base portion. The base portion is adapted to be mounted on an annular boss extending from the headpiece. The thumb supporting portion includes a thumb contacting surface which extends outwardly at an acute angle with respect to the longitudinal axis of the base portion. The thumb contacting surface is patterned and is generally sinusoidal in profile and convex in cross section for supporting an operator's thumb in a partially flexed position along substantially the entire length of the thumb.

FINALLY, STILL YET ANOTHER EXAMPLE, U.S. Pat. No. 5,606,772 to Ilic teaches a universal primary hand grip device for use with tools and utensils. The primary hand grip has multiple angles by which the hand can grip the shaft of a tool or utensil, thus making the grip ergonomically efficient. When used in combination with a secondary cross-handle, a tool or utensil can become quite easy to use and comfortable to operate. The primary hand grip device of this invention has a grip that slides over, or is made integral with, the end of the shaft of a tool or utensil. The hand grip has a multiply-angled surface, in which he primary hand can assume a substantially straight-angled position (180 degree angle) with respect to the axis of the wrist. The correct hand position varies with each tool and with each work surface. The proper grip angle for a particular task allows the hand to maintain a straight angle with respect to the wrist axis, while also imparting the driving force of the arm into the shaft of the tool.

It is apparent that numerous innovations for ergonomic devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a squeegee with ergonomic handle and non-loosening pivotable blade that avoids the disadvantages of the prior art.

ANOTHER OBJECT of the present invention is to provide a squeegee with ergonomic handle and non-loosening pivotable blade that is simple and inexpensive to manufacture.

STILL ANOTHER OBJECT of the present invention is to provide a squeegee with ergonomic handle and non-loosening pivotable blade that is simple to use.

BRIEFLY STATED, YET ANOTHER OBJECT of the present invention is to provide a squeegee with ergonomic handle and non-loosening pivotable blade. The squeegee includes a handle for one of attaching to a pole and holding in a hand of a user, a blade portion pivotally mounted to the handle for side to side pivotal movement relative thereto, and pivoting apparatus for pivotally mounting the blade portion to the handle for side to side pivotal movement relative thereto. A flat longitudinal side of a threaded shaft of a specifically configured bolt contacts, and locks against, a flat longitudinal side of a specifically configured throughbore in the handle preventing loosing and rotation of the specifically configured bolt relative to the handle when the blade portion is pivoted relative to the handle, with the tapering of a head of the specifically configured bolt creating a mechanical advantage of increased friction between the head and the flared portion of a specifically configured throughbore in the blade portion, and with the pivoting apparatus being positioned at a slanted edge of the blade portion and the side of the handle and not the center of the blade portion and the center of the handle preventing the blade portion from hitting the hand of the user when it pivots to an extreme.

The novel features which are considered characteristic of the present invention are set forth in the appended claims.

The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows.

LIST OF REFERENCE NUMERALS UTILIZED IN THE DRAWING

Figure 4:
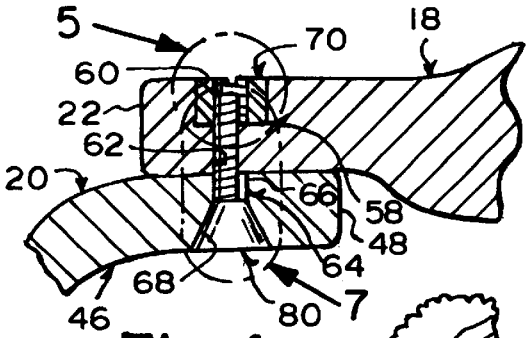
FIG. 4 is an enlarged cross sectional view taken on line 4—4 in FIG. 2.

10 squeegee with ergonomic handle and non-loosening pivotable blade of the present invention
12 pole held by user 14
14 user
16 hand of user 14
18 handle for one of attaching to pole 12 and holding in hand 16 of user 14
20 blade portion pivotally mounted to handle 18
22 forwardmost end of handle 18
24 pivoting apparatus for pivotally mounting blade portion 20 to handle 18
26 rearmost end of handle 18
28 axial bore in rearmost end 26 of handle 18
30 lowermost surface of handle 18
31 portion of lowermost surface 30 of handle 18
32 forwardmost point of portion 31 of lowermost surface 30 of handle 18
34 rearmost point of portion 31 of lowermost surface 30 of handle 18
36 uppermost surface of handle 18
38 forwardmost point of bulge of uppermost surface 36 of handle 18
40 rearmost point of bulge of uppermost surface 36 of handle 18
42 recession in uppermost surface of forwardmost end 22 of handle 18
43 side surface of handle 18
45 forwardmost point of bulge of side surface 43 of handle 18
46 neck of blade portion 20
47 rearmost point of bulge of side surface 43 of handle 18
48 short side of neck 46 of blade portion 20
50 long side of neck 46 of blade portion 20
52 channel of blade portion 20
54 lowermost surface 54 of neck 46 of blade portion 20
56 flexible squeegee blade of blade portion 20
58 specifically configured throughbore in forwardmost end 22 of handle 18
60 wide portion of specifically configured throughbore 58 in forwardmost end 22 of handle 18
62 narrow portion of specifically configured throughbore 58 in forwardmost end 22 of handle 18
64 specifically configured throughbore in neck 46 of blade portion 20
65 slanted edge of neck 46 of blade portion 20
66 narrow portion of specifically configured throughbore 64 in neck 46 of blade portion 20
68 flared portion of specifically configured throughbore 64 in neck 46 of blade portion 20
70 specifically configured nut
72 threaded throughbore in specifically configured nut 70
74 uppermost surface of specifically configured nut 70
76 lowermost surface of specifically configured nut 70
78 slot in uppermost surface 74 of specifically configured nut 70
80 specifically configured bolt
82 head of specifically configured bolt 80
84 threaded shaft of specifically configured bolt 80

DESCRIPTION OF THE PREFERRED EMBODIMENT

Figure 1:
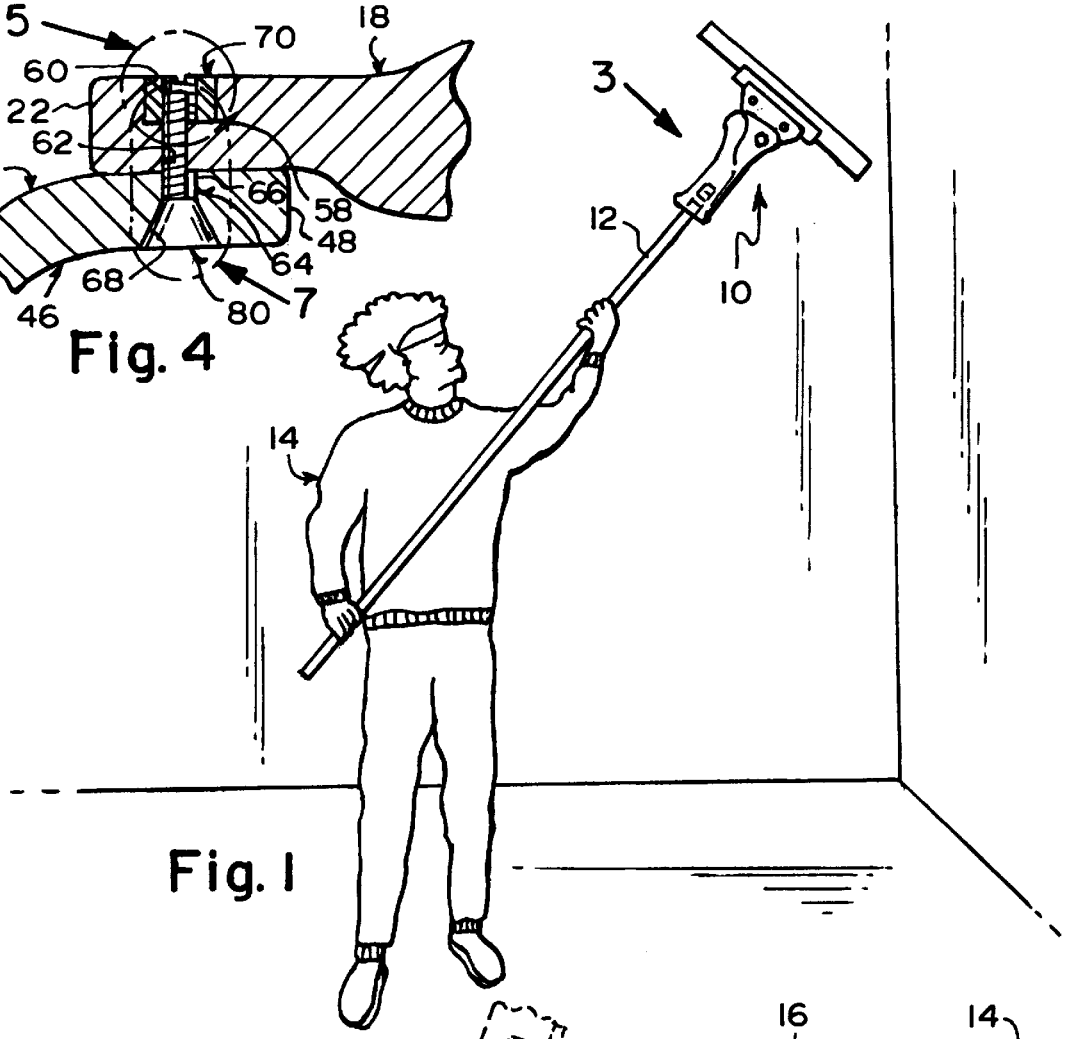
FIG. 1 is a diagrammatic perspective view of the present invention attached to a pole and in use.
Figure 2:
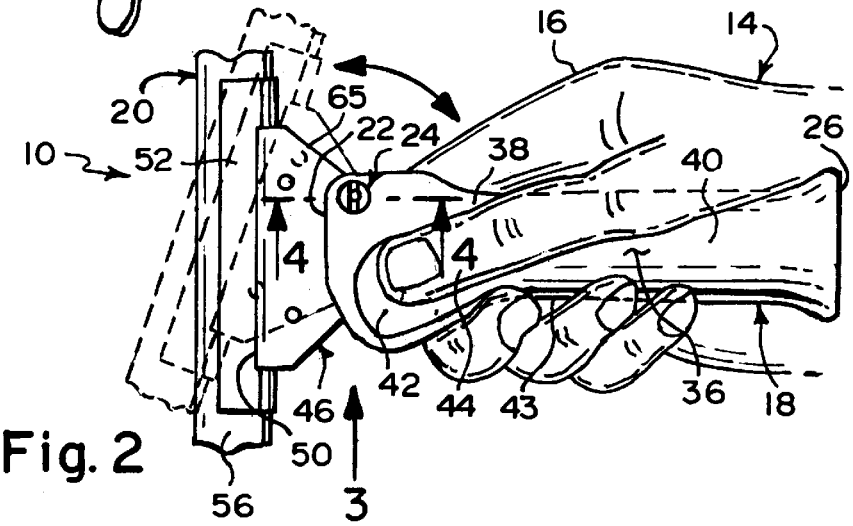
FIG. 2 is a diagrammatic perspective view of the present invention held in a hand and in use.

Referring now to the figures in which like numerals indicate like parts, and particularly to FIGS. 1 and 2, respectively, the squeegee with ergonomic handle and non-loosening pivotable blade of the present invention is shown generally at 10 for one of attaching to a pole 12 held by a user 14 and holding in a hand 16 of the user 14.

Figure 3:
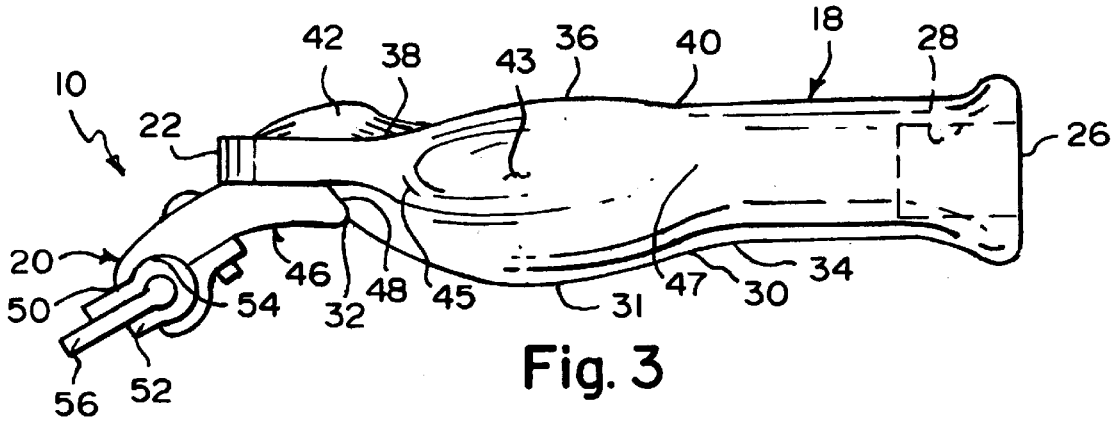
FIG. 3 is an enlarged diagrammatic side elevational view of the present invention taken generally in the direction of arrow 3 in FIGS. 1 and 2.

The configuration of the squeegee with ergonomic handle and non-loosening pivotable blade 10 can best be seen in FIGS. 2 and 3, and as such will be discussed with reference thereto.

The squeegee with ergonomic handle and non-loosening pivotable blade 10 comprises a handle 18 for one of attaching to the pole 12 and holding in the hand 16 of the user 14.

The squeegee with ergonomic handle and non-loosening pivotable blade 10 further comprises a blade portion 20 that is pivotally mounted to the handle 18, at its forwardmost end 22 that has a center and a pair of sides, for side to side pivotal movement relative thereto.

The squeegee with ergonomic handle and non-loosening pivotable blade 10 further comprises pivoting apparatus 24 for pivotally mounting the blade portion 20 to the handle 18 for side to side pivotal movement relative thereto.

The handle 18 is substantially cylindrically-shape and extends from its forwardmost end 22, that is substantially flattened on its uppermost and lowermost surfaces and flares laterally outwardly, to its rearmost end 26, that is slightly radially outwardly flared and contains an axial bore 28 for receiving the pole 12.

The handle 18 further has a lowermost surface 30 that has a portion 31 that depends bulgingly from a forwardmost point 32, that is slightly rearward of the forwardmost end 22 of the handle 18, to a rearmost point 34, that is about midway of the handle 18 for supporting the palm of the hand 14 of the user 16.

The handle 18 further has an uppermost surface 36 that extends slightly bulgingly upwardly from a forwardmost point 38, that is substantially in line with the forwardmost point 32 of the portion 31 of the lowermost surface 30 of the handle 18, to a rearmost point 40, that is substantially in line with the rearmost point 34 of the portion 31 of the lowermost surface 30 of the handle 18.

The uppermost surface of the forwardmost end 22 of the handle 18 has a recession 42 therein that extends along, and slightly inward of, one side of the forwardmost end 22 of the handle 18 for supporting the thumb 44 of the hand 16 of the user 14.

The handle 18 further has a side surface 43 that extends slightly bulgingly sidewardly from a forwardmost point 45, that is substantially in line with the forwardmost point 32 of the portion 31 of the lowermost surface 30 of the handle 18, to a rearmost point 47, that is substantially in line with the rearmost point 34 of the portion 31 of the lowermost surface 30 of the handle 18 for supporting the fingers of the hand 14 of the user 16.

The blade portion 20 comprises a neck 46 that is substantially flat and substantially trapezoidal-shaped and has a pair of slanted edges and a center, with its short side 48 facing the forwardmost end 22 of the handle 18 and being pivotally mounted to the lowermost surface of the forwardmost end 22 of the handle 18, and with its long side 50 depending forwardly therefrom.

The blade portion 20 further comprises a channel 52 that is elongated and attached to the neck 46 of the blade portion 20, on its lowermost surface 54 for lateral pivotal movement therewith. The channel 52 of the blade portion 20 extends parallely along, and opens away from, the long side 50 of the neck 46 of the blade portion 20, and outwardly of both sides thereof The blade portion 20 further comprises a flexible squeegee blade 56 that is replaceably mounted in the channel 52 of the blade portion 20.

The configuration of the pivoting apparatus 24 can best be seen in FIGS. 4–8, and as such will be discussed with reference thereto.

As shown in FIG. 4, the pivoting apparatus 24 comprises the forwardmost end 22 of the handle 18 having a specifically configured throughbore 58 that extends axially from its uppermost surface to its lowermost surface, in proximity to its forwardmost point and a side away from the recession 42 in the uppermost surface of the forwardmost end 22 of the handle 18 so as to be at one side of the pair of sides of the forwardmost end 22 of the handle 18 and not the center of the forwardmost end 22 of the handle 18.

As shown in FIG. 4, the specifically configured throughbore 58 in the forwardmost end 22 of the handle 18 comprises a wide portion 60 that is cylindrically-shaped and non-threaded and depends axially from the uppermost surface of the forwardmost end 22 of the handle 18 to a point generally midway between the uppermost and lowermost surfaces of the forwardmost end 22 of the handle 18.

As shown in FIG. 4, the specifically configured throughbore 58 in the forwardmost end 22 of the handle 18 further comprises a narrow portion 62 that is non-threaded and D-shaped in lateral profile with a flat longitudinal side. The narrow portion 62 of the specifically configured throughbore 58 in the forwardmost end 22 of the handle 18 depends coaxially from, is narrower than, and communicates with, the wide portion 60 of the specifically configured throughbore 58 in the forwardmost end 22 of the handle 18, to the lowermost surface of the forwardmost end 22 of the handle 18.

As shown in FIG. 4, the pivoting apparatus 24 further comprises the neck 46 of the blade portion 20 having a specifically configured throughbore 64 that extends axially from its uppermost surface to its lowermost surface, in proximity to its short side 36 and a slanted edge 65 of the pair of slanted edges of the neck 46 of the blade portion 20 so as to be at an edge of the pair of slanted edges of the neck 46 of the blade portion 20 and not the center of the neck 46 of the blade portion 20, and aligned with the specifically configured throughbore 58 in the forwardmost end 22 of the handle 18.

As shown in FIG. 4, the specifically configured throughbore 64 in the neck 46 of the blade portion 20 comprises a narrow portion 66 that is cylindrically-shaped and non-threaded and depends from the uppermost surface of the neck 46 of the blade portion 20 to generally midway between the uppermost and lowermost surfaces of the neck 46 of the blade portion 20.

As shown in FIG. 4, the specifically configured throughbore 64 in the neck 46 of the blade portion 20 further comprises a flared portion 68 that depends coaxially from, flares dependently from, and communicates with, the narrow portion 66 of the specifically configured throughbore 64 in the neck 46 of the blade portion 20, to the lowermost surface of the neck 46 of the blade portion 20.

As shown in FIG. 4, the pivoting apparatus 24 further comprises a specifically configured nut 70 that is disposed in, and fills, the wide portion 60 of the specifically configured throughbore 58 in the forwardmost end 22 of the handle 22 for rotation relative thereto.

Figure 6:
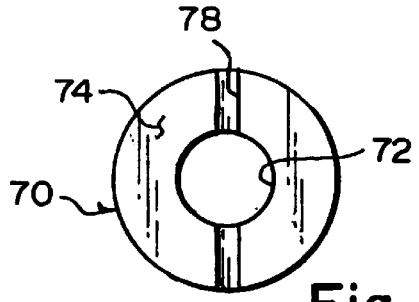
FIG. 6 is a diagrammatic top plan view taken generally in the direction of arrow 6 in FIG. 5.
Figure 5:
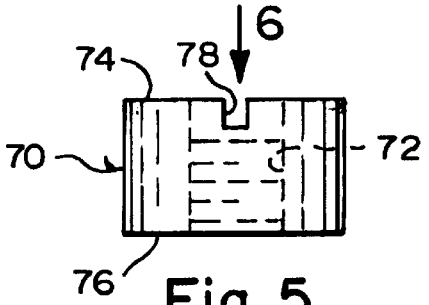
FIG. 5 is an enlarged diagrammatic side elevational view of the area generally enclosed by the dotted ellipse identified by arrow 5 in FIG. 4 of just the specifically configured pivot nut.

As shown in FIGS. 5 and 6, the specifically configured nut 70 is cylindrically-shaped, short, and stubby, and has a threaded throughbore 72 that extends axially from its uppermost surface 74 to its lowermost surface 76, with its uppermost surface 74 having a slot 78 that extends diametrically thereacross, communicates with the threaded throughbore 72 in the specifically configured nut 70, and is for receiving the blade of a screw driver.

As shown in FIG. 4, the pivoting apparatus 24 further comprises a specifically configured bolt 80 that extends upwardly through, and fills, the flared portion 68 of the specifically configured throughbore 64 in the neck 46 of the blade portion 20, upwardly through the narrow portion 66 of the specifically configured throughbore 64 in the neck 46 of the blade portion 20, upwardly through, and fills, the narrow portion 62 of the specifically configured throughbore 58 in the forwardmost end 22 of the handle 18, and threadably engages the specifically configured nut 70.

Figure 8:
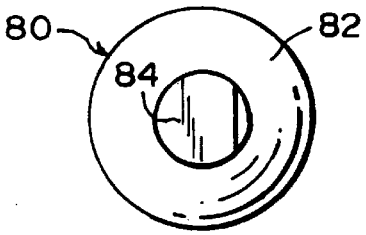
FIG. 8 is a diagrammatic top plan view taken generally in the direction of arrow 8 in FIG. 7.
Figure 7:
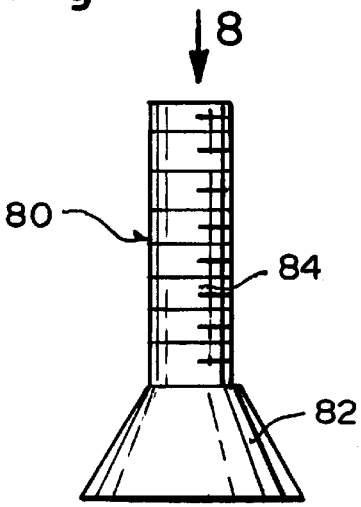
FIG. 7 is an enlarged diagrammatic side elevational view of the area generally enclosed by the dotted ellipse identified by arrow 7 in FIG. 4 of just the specifically configured pivot bolt.

As shown in FIGS. 7 and 8, the specifically configured bolt 80 comprises a head 82 that tapers upwardly and fills the flared portion 68 of the specifically configured throughbore 64 in the neck 46 of the blade portion 20.

As shown in FIGS. 7 and 8, the specifically configured bolt 80 further comprises a threaded shaft 84 that is D-shaped in lateral profile with a flat longitudinal side, and extends upwardly from the head 82 of the specifically configured bolt 80, upwardly through the narrow portion 66 of the specifically configured throughbore 64 in the neck 46 of the blade portion 20, upwardly through, and fills, the narrow portion 62 of the specifically configured throughbore 58 in the forwardmost end 22 of the handle 18, and threadably engages the specifically configured nut 70, with the flat longitudinal side of the threaded shaft 84 of the specifically configured bolt 80 contacting, and locking against, the flat longitudinal side of the narrow portion 62 of the specifically configured throughbore 58 in the forwardmost end 22 of the handle 18 preventing loosening and rotation of the specifically configured bolt 80 relative to the forwardmost end 22 of the handle 18 when the blade portion 20 is pivoted relative to the handle 18, with the tapering of the head 82 of the specifically configured bolt 80 creating a mechanical advantage of increased friction between the head 82 of the specifically configured bolt 80 and the flared portion 68 of the specifically configured throughbore 64 in the neck 46 of the blade portion 20, with the slot 78 in the uppermost surface 74 of the specifically configured nut 70 allowing the specifically configured nut 70 to be threaded relative to the specifically configured bolt 80 since the specifically configured bolt 80 is locked against rotation, and with the pivoting apparatus 24 being positioned at the edge of the pair of slanted edges of the neck 46 of the blade portion 20 and the side of the forwardmost end 22 of the handle 18 and not the center of the neck 46 of the blade portion 20 and the center of the forwardmost end 22 of the handle 18 preventing the blade portion 20 from hitting the hand 16 of the user 14 when it pivots to an extreme.

It will be understood that each of the elements described above, or two or more together, may also find a useful application in other types of constructions differing from the types described above.

While the invention has been illustrated and described as embodied in a squeegee with ergonomic handle and non-loosening pivotable blade, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A squeegee with ergonomic handle and non-loosening pivotable blade for one of attaching to a pole held by a user and holding in a hand of the user, said squeegee comprising:

a) a handle for one of attaching to the pole and holding in the hand of the user;

b) a blade portion pivotally mounted to said handle, at a forwardmost end of said handle with a center and a pair of sides, for side to side pivotal movement relative thereto; and c) pivoting means for pivotally mounting said blade portion to said handle for side to side pivotal movement relative thereto, wherein said handle is substantially cylindrically-shaped and extends from said forwardmost end of said handle that has a pair of sides and a center and is substantially flattened on an uppermost and a lowermost surface and flares laterally outwardly to a rearmost end that is slightly radially outwardly flared and contains an axial bore for receiving the pole, wherein said handle further has said lowermost surface with a portion that depends bulgingly from a forwardmost point that is slightly rearward of said forwardmost end of said handle to a rearmost point that is about midway of said handle for supporting the palm of the hand of the user.

2. The squeegee as defined in claim 1, wherein said handle further has an uppermost surface that extends slightly bulgingly upwardly from a forwardmost point that is substantially in line with said forwardmost point of said portion of said lowermost surface of said handle to a rearmost point that is substantially in line with said rearmost point of said portion of said lowermost surface of said handle.

3. The squeegee as defined in claim 2, wherein said uppermost surface of said forwardmost end of said handle has a recession therein that extends along, and slightly inward of, one side of said pair of sides of said forwardmost end of said handle for supporting the thumb of the hand of the user.

4. The squeegee as defined in claim 3, wherein said blade portion comprises a neck that is substantially flat and substantially trapezoidal-shaped and has a pair of slanted edges and a center, with its short side facing said forwardmost end of said handle and being pivotally mounted to said lowermost surface of said forwardmost end of said handle, and with its long side depending forwardly therefrom.

5. The squeegee as defined in claim 4, wherein said blade portion further comprises a channel that is elongated and attached to said neck of said blade portion, on its lowermost surface, for lateral pivotal movement therewith.

6. The squeegee as defined in claim 5, wherein said channel of said blade portion extends parallely along, and opens away from, said long side of said neck of said blade portion, and outwardly of both sides thereof.

7. The squeegee as defined in claim 5, wherein said blade portion further comprises a flexible squeegee blade that is replaceably mounted in said channel of said blade portion.

8. The squeegee as defined in claim 4, wherein said pivoting means comprises said forwardmost end of said handle having a specifically configured throughbore that extends axially from its uppermost surface to its lowermost surface, in proximity to its forwardmost point and a side of said pair of sides of said forwardmost end of said handle away from said recession in said uppermost surface of said forwardmost end of said handle so as to be at one side of said pair of sides of said forwardmost end of said handle and not said center of said forwardmost end of said handle.

9. The squeegee as defined in claim 8, wherein said specifically configured throughbore in said forwardmost end of said handle comprises a wide portion that is cylindrically-shaped and non-threaded and depends axially from said uppermost surface of said forwardmost end of said handle to a point generally midway between said uppermost and lowermost surfaces of said forwardmost end of said handle.

10. The squeegee as defined in claim 9, wherein said specifically configured throughbore in said forwardmost end of said handle further comprises a narrow portion that is non-threaded and D-shaped in lateral profile with a flat longitudinal side.

11. The squeegee as defined in claim 10, wherein said narrow portion of said specifically configured throughbore in said forwardmost end of said handle depends coaxially from, is narrower than, and communicates with, said wide portion of said specifically configured throughbore in said forwardmost end of said handle to said lowermost surface of said forwardmost end of said handle.

12. The squeegee as defined in claim 10, wherein said pivoting means further comprises said neck of said blade portion having a specifically configured throughbore that extends axially from its uppermost surface to its lowermost surface, in proximity to its short side and a slanted edge of said pair of slanted edges of said neck of said blade portion so as to be at an edge of said pair of slanted edges of said neck of said blade portion and not said center of said neck of said blade portion, and aligned with said specifically configured throughbore in said forwardmost end of said handle.

13. The squeegee as defined in claim 12, wherein said specifically configured throughbore in said neck of said blade portion comprises a narrow portion that is cylindrically-shaped and non-threaded and depends from said uppermost surface of said neck of said blade portion to generally midway between said uppermost and lowermost surfaces of said neck of said blade portion.

14. The squeegee as defined in claim 13, wherein said specifically configured throughbore in said neck of said blade portion further comprises a flared portion that depends coaxially from, flares dependently from, and communicates with, said narrow portion of said specifically configured throughbore in said neck of said blade portion to said lowermost surface of said neck of said blade portion.

15. The squeegee as defined in claim 14, wherein said pivoting means further comprises a specifically configured nut that is disposed in, and fills, said wide portion of said specifically configured throughbore in said forwardmost end of said handle for rotation relative thereto.

16. The squeegee as defined in claim 15, wherein said specifically configured nut is cylindrically-shaped, short, and stubby, and has a threaded throughbore that extends axially from its uppermost surface to its lowermost surface, with its uppermost surface having a slot that extends diametrically thereacross, communicates with said threaded throughbore in said specifically configured nut, and is for receiving a blade of a screw driver.

17. The squeegee as defined in claim 16, wherein said pivoting means further comprises a specifically configured bolt that extends upwardly through, and fills, said flared portion of said specifically configured throughbore in said neck of said blade portion, upwardly through said narrow portion of said specifically configured throughbore in said neck of said blade portion, upwardly through, and fills, said narrow portion of said specifically configured throughbore in said forwardmost end of said handle, and threadably engages said specifically configured nut.

18. The squeegee as defined in claim 17, wherein said specifically configured bolt comprises a head that tapers upwardly and fills said flared portion of said specifically configured throughbore in said neck of said blade portion.

19. The squeegee as defined in claim 18, wherein said specifically configured bolt further comprises a threaded shaft that is D-shaped in lateral profile with a flat longitudinal side, and extends upwardly from said head of said specifically configured bolt, upwardly through said narrow portion of said specifically configured throughbore in said neck of said blade portion, upwardly through, and fills, said narrow portion of said specifically configured throughbore in said forwardmost end of said handle, and threadably engages said specifically configured nut, with said flat longitudinal side of said threaded shaft of said specifically configured bolt contacting, and locking against, said flat longitudinal side of said narrow portion of said specifically configured throughbore in said forwardmost end of said handle preventing loosing and rotation of said specifically configured bolt relative to said forwardmost end of said handle when said blade portion is pivoted relative to said handle, with tapering of said head of said specifically configured bolt creating a mechanical advantage of increased friction between said head of said specifically configured bolt and said flared portion of said specifically configured throughbore in said neck of said blade portion, with said slot in said uppermost surface of said specifically configured nut allowing said specifically configured nut to be threaded relative to said specifically configured bolt since said specifically configured bolt is locked against rotation, and with said pivoting means being positioned at said edge of said pair of slanted edges of said neck of said blade portion and said side of said forwardmost end of said handle and not said center of said neck of said blade portion and said center of said forwardmost end of said handle preventing said blade portion from hitting the hand of the user when it pivots to an extreme.

20. The squeegee as defined in claim 2, wherein said handle further has a side surface that extends slightly bulgingly sidewardly from a forwardmost point that is substantially in line with said forwardmost point of said portion of said lowermost surface of said handle to a rearmost point that is substantially in line with said rearmost point of said portion of said lowermost surface of said handle for supporting the fingers of the hand of the user.

* * * * *